United States Patent [19]

Heusinkveld

[11] Patent Number: 4,607,970

[45] Date of Patent: Aug. 26, 1986

[54] BINDER FOR PERFORATED SHEETS

[75] Inventor: Paul Heusinkveld, 3800 N. Fairfax Dr., Apt. 1112, Arlington, Va. 22203

[73] Assignees: Ted Scudder; Paul Heusinkveld, both of Arlington, Va.

[21] Appl. No.: 698,445

[22] Filed: Feb. 5, 1985

[51] Int. Cl.[4] ..... B42F 13/16; B42F 13/02

[52] U.S. Cl. ..... 402/20; 402/19; 402/80 P

[58] Field of Search ..... 402/19, 20, 80 P, 80 R

[56] References Cited

U.S. PATENT DOCUMENTS

| | | | |
|---|---|---|---|
| 833,458 | 10/1906 | Hausherr | 402/19 |
| 2,099,881 | 10/1935 | Emmer | 402/20 |
| 3,205,897 | 11/1962 | Jamison | 402/20 |
| 3,251,364 | 11/1964 | Goldman | 402/22 |
| 3,270,749 | 10/1985 | O'Connell | 402/20 |
| 3,331,373 | 10/1965 | Lohmeier | 402/20 X |
| 3,529,900 | 11/1967 | Pettit | 402/22 |
| 3,728,036 | 4/1973 | Cott | 402/31 |

FOREIGN PATENT DOCUMENTS

| | | | |
|---|---|---|---|
| 509621 | 2/1955 | Canada | 402/19 |

*Primary Examiner*—Robert L. Spruill
*Assistant Examiner*—Taylor J. Ross
*Attorney, Agent, or Firm*—Richard C. Litman

[57] ABSTRACT

A one piece binder for perforated sheets, including a base portion and at least a ring. The ring comprised two members which, when locked, present a smooth and continuous surface and, when unlocked, are spring-biased apart. The locking means on one ring member terminates in resilient guide and latching portions which are received in an apertured portion of the other member.

8 Claims, 4 Drawing Figures

BINDER FOR PERFORATED SHEETS

BACKGROUND OF THE INVENTION

The present invention relates to a device for holding a plurality of perforated sheets or the like. These devices are commonly referred to as binders, and include at least a base member and a plurality of rings for holding the sheets.

Numerous prior binders include several independent pieces which are required to be assembled together to complete the device. Thus, the cost of assembly needs to be added to the overall cost of the device. The binder is relatively expensive as compared to the cost of the paper it binds together.

Binders are also assembled in the form of a conventional notebook, wherein the number of sheets that can be adequately carried is limited to the width of the base member. Many looseleaf notebooks, therefore, have relatively wide base members and, of course, require a cover member to be integrated into the assembly.

Some binders have protruding locking means which obstruct free movement of the sheets on the rings. The locking means on the binders may not latch in all directions and is subject to being inadvertently opened or distorted out of alignment; still other binders require the use of both hands to release the latch.

SUMMARY OF THE INVENTION

The present device overcomes the previously mentioned deficiencies and provides a one-piece binder having a base member and at least one ring to carry a plurality of sheets. Therefore, the cost of manufacture is minimized, and can be accomplished by a conventional molding process for a plastic binder or a conventional metal working or casting process for a metal binder.

An object of the present invention is to provide a binder which will permit the sheets to flip over in a manner corresponding to a spiral notebook. This is accomplished by having a narrow base along with a ring having a uniform cross-section throughout its length and a substantially constant radius of curvature. The binder can, therefore, be used on a desk top as a card file.

Another object is to provide a strong and durable locking arrangement which is easily latched. Included in the locking means is a guide member having top, bottom and lateral sides and an internal opening extending to one side and defining a laterally extending locking surface portion which assures proper alignment and latching of the two portions of the ring by merely squeezing them together. Since the two portions of each ring are biased away from each other, unlatching is easily obtained by merely squeezing the guide and locking members together. The locking member on the one ring portion being a pair of resilient projecting members having top, bottom and lateral sides separated by an elongated slot, one of the projecting members having a laterally extending surface portion whereby when the two ring portions are brought together, the projecting members of the one portion enter the guide member and the two laterally extending surface portions are brought into releasable locking engagement. The locking member thus moves out of a side locking aperture, thereby allowing the two ring portions to spring apart.

Another object is to provide a binder that is potentially disposable. This attribute is achieved by virtue of the extreme low cost of the materials that compose the binder and the fact that it does not require assembly. The binder will likely cost less than the paper in it.

BRIEF DESCRIPTION OF THE DRAWINGS

The features and objects of the invention will be better understood by referring to the accompanying drawing in which.

DESCRIPTION OF THE PREFERRED EMBODIMENT

Figure 1:
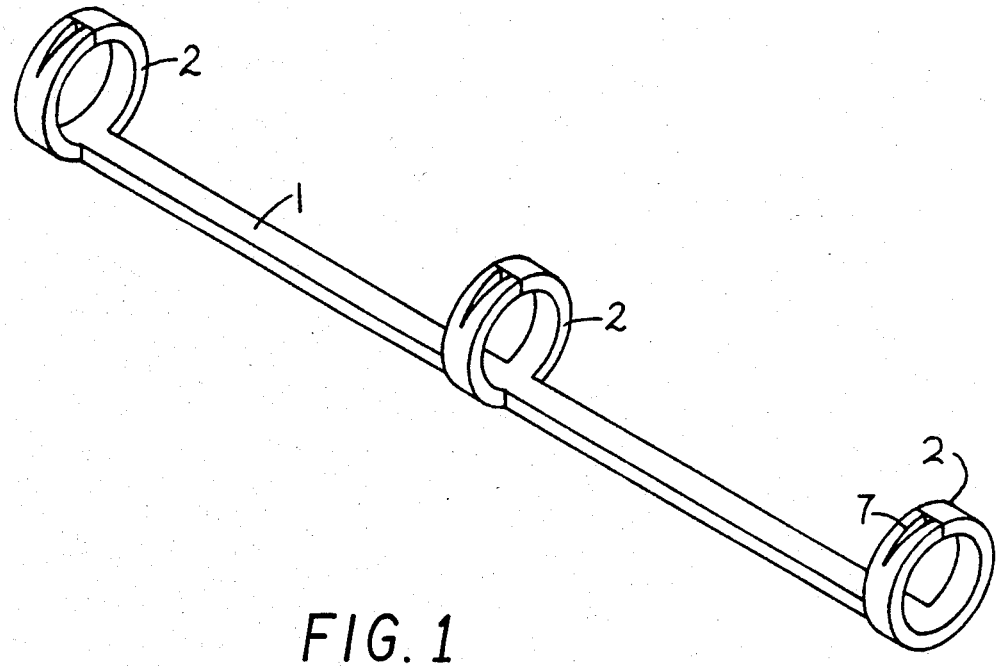
FIG. 1 is a perspective view of the binder having three rings.

FIG. 1 illustrates a typical arrangement of the binder of the present invention having a base 1 and a plurality of ring 2 in their latched position.

Figure 2:
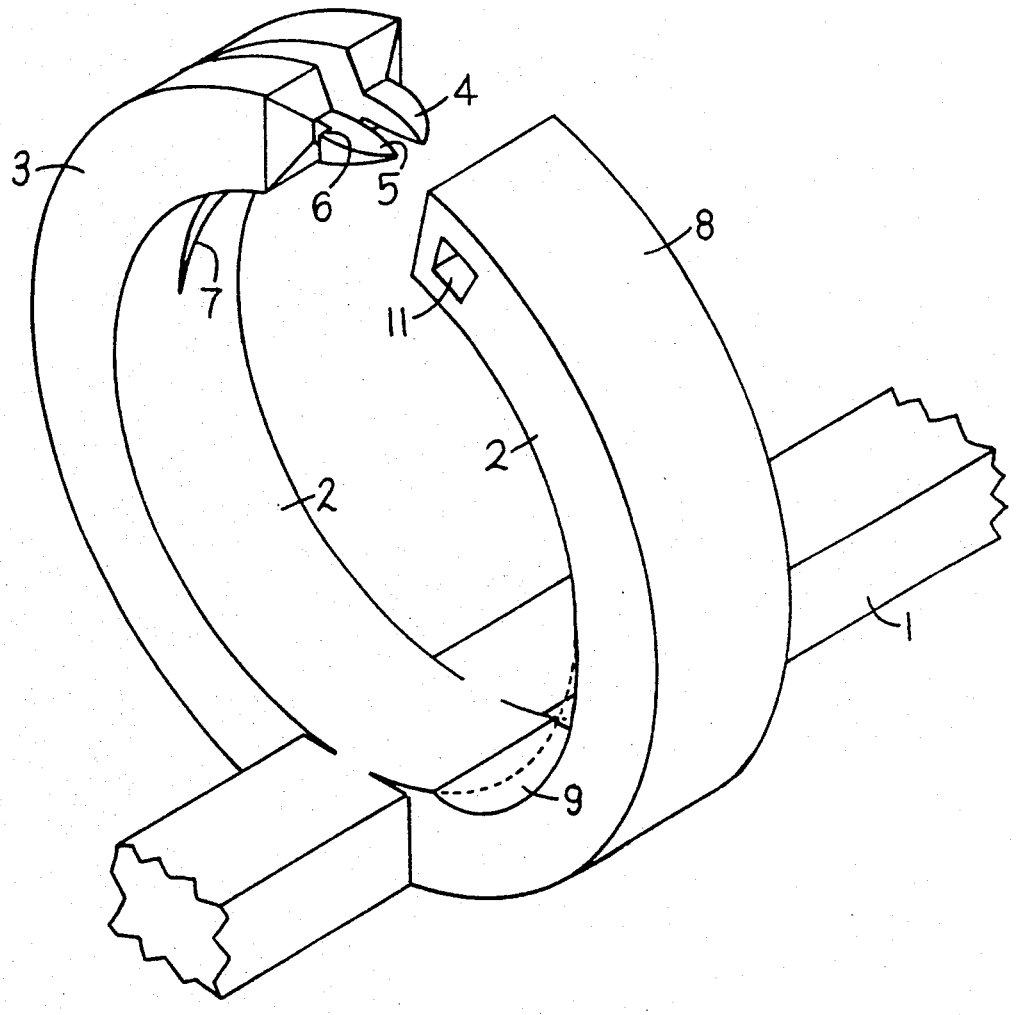
FIG. 2 is a perspective view of a portion of the binder wherein the ring is in its unlatched position.

FIG. 2 further illustrates the invention, wherein the ring 2 has a portion 3 which terminates in a guide member 4, and a latching member 5 having a laterally extending locking surface 6. The members 4 and 5 are separated from each other by an elongated slot 7. Ring portion 8 is provided at its end adjacent to the base 1 with a depression 9 which provides a hinging action between the base and the ring portion. By merely squeezing these two ring portions together with the thumb and finger on one's hand, the guide 4 latching member 5 are moved into an aperture within the end of ring portion 8, thus permitting the locking surface 6 to snap into the side opening 11 and locking against surface 12.

Figure 3A:
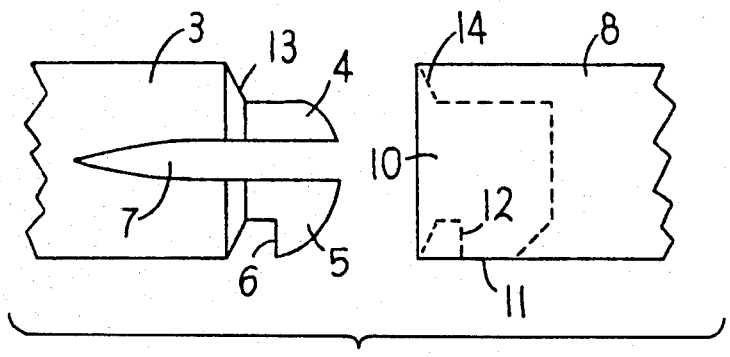
FIG. 3A and 3B are two orthogonal views of the ends of an opposed pair of ring portions.
Figure 3B:
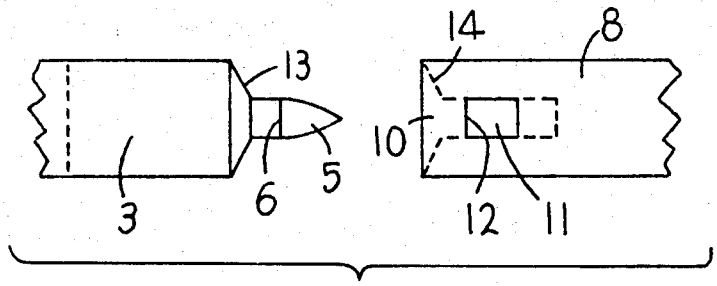

The aperture 10, along with its locking surface 12 and side opening 11, is better illustrated in FIG. 3A and FIG. 3B. Also, surfaces 13 and 14 of the two ring portions will abut in the locked position.

With the ring portions in their locked position, as shown in FIG. 1, the ring presents a continuous surface so that any sheet, card or leaf carried by the ring may be readily moved through the joint coupling the two ring portions. Also, by squeezing together the end members of the ring portion 3 adjacent the slot 7 in a direction away from the side opening 11, the latching member 5 is easily moved out of its locking engagement with surface 12, whereby the two ring portions will spring apart into their opened position. This squeezing for unlatching can also be accomplished with the use of only a thumb and finger on one hand, thereby providing a quick release of the latched ring portions.

I claim:

1. An easily openable and closable one piece binder made of molded plastic material including a narrow elongated base member which allows bound sheets to flip over in a manner corresponding to the sheets in a spiral notebook and at least one pair of mounted plastic ring portions projecting laterally from opposite sides of said base member, said at least one pair in substantial alignment with each other, one of each said at least one pair of ring portions terminating in a pair of resilient projecting members having top, bottom and lateral sides, said projecting members being separated by an elongated slot, the other one of said at least one pair of ring portions terminating in a guide member having top, bottom and lateral sides, said guide member shaped to receive said pair of projecting members so that the outer surfaces of the rings join to form a surface which does not obstruct free movement of the sheets on the rings, said guide member having a section extending to one side of said other ring portion and defining a laterally extending locking surface portion, one of said projecting members also having a laterally extending locking surface portion corresponding to the laterally extending surface portion in said other ring portion whereby when said two ring portions are moved toward each other, the projecting members of said one ring portion enter the guide memeber in the other ring portion and said two laterally extending surface portions are brought into releasable locking engagement, requiring squeezing the elongated slot separated members laterally in parallel to the base member for easily releasable disengagement.

2. The binder of claim 1 wherein said opposed ring portions are biased away from each other in the unlocked position.

3. The binder of claim 1 wherein the ring portion presents a uniform, external cross-section throughout its length when latched.

4. The binder of claim 1 wherein the base member and ring portions are made of disposable material.

5. The binder of claim 1 comprising a plurality of said pairs of opposed ring portions.

6. The binder of claim 5 wherein said opposed ring portions of each pair are biased away from each other in the unlocked position.

7. The binder of claim 5 wherein each ring portion presents a uniform, external cross-section throughout its length when latched.

8. The binder of claim 5 wherein the base member and ring portions are made of disposable material.

* * * * *